US011056791B2

(12) United States Patent
Zekios et al.

(10) Patent No.: US 11,056,791 B2
(45) Date of Patent: Jul. 6, 2021

(54) ARRAYS WITH FOLDABLE AND DEPLOYABLE CHARACTERISTICS

(71) Applicants: Constantinos L. Zekios, Miami, FL (US); Stavros Georgakopoulos, Miami, FL (US); Muhammad Hamza, Miami, FL (US)

(72) Inventors: Constantinos L. Zekios, Miami, FL (US); Stavros Georgakopoulos, Miami, FL (US); Muhammad Hamza, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/680,673

(22) Filed: Nov. 12, 2019

(65) Prior Publication Data

US 2021/0143551 A1 May 13, 2021

(51) Int. Cl.

| | |
|---|---|
| ***H01Q 9/04*** | (2006.01) |
| ***H01Q 1/08*** | (2006.01) |
| ***H01Q 1/38*** | (2006.01) |
| ***H01Q 9/28*** | (2006.01) |

(52) U.S. Cl.

CPC ..... *H01Q 9/0414* (2013.01); *H01Q 1/08* (2013.01); *H01Q 1/38* (2013.01); *H01Q 9/285* (2013.01)

(58) Field of Classification Search

CPC .. H01Q 21/065; H01Q 21/0075; H01Q 1/243; H01Q 1/08; H01Q 1/38; H01Q 9/285

See application file for complete search history.

(56) References Cited

U.S. PATENT DOCUMENTS

| | | | | |
|---|---|---|---|---|
| 7,920,100 | B2 * | 4/2011 | Brown | F41H 13/0068 343/818 |
| 8,648,770 | B2 * | 2/2014 | Schneider | H01Q 9/0421 343/893 |
| 9,024,839 | B2 * | 5/2015 | Schneider | H01Q 9/0421 343/893 |
| 9,627,775 | B2 * | 4/2017 | Nakatsu | H01Q 21/30 |
| 9,706,646 | B2 * | 7/2017 | Jiang | H05K 1/0278 |
| 2004/0155819 | A1 * | 8/2004 | Martin | H04W 40/02 343/700 MS |
| 2009/0009421 | A1 * | 1/2009 | Suprunov | H01Q 1/38 343/881 |
| 2015/0342050 | A1 * | 11/2015 | Jiang | H05K 1/0278 361/749 |
| 2018/0278200 | A1 * | 9/2018 | Jeon | H02S 30/20 |

* cited by examiner

*Primary Examiner* — Dameon E Levi
*Assistant Examiner* — Jennifer F Hu
(74) *Attorney, Agent, or Firm* — Saliwanchik, Lloyd & Eisenschenk

(57) ABSTRACT

Antenna devices are provided, including tightly coupled arrays, transmitarrays, and reflectarrays. An antenna device can include a plurality of substrates each having an antenna element. The substrates can be provided in connected series or in an array. The substrates can be part of an origami array such that the entire array is foldable. The substrates can optionally be attached to a framework that can actuate the substrates to different configurations. By bending, folding, or otherwise repositioning the substrates/array, the electromagnetic characteristics of the antenna device can be easily reconfigured for the desired task.

14 Claims, 15 Drawing Sheets

ARRAYS WITH FOLDABLE AND DEPLOYABLE CHARACTERISTICS

GOVERNMENT SUPPORT

This invention was made with government support under Award Number FA9550-18-1-0191 awarded by the Air Force. The government has certain rights in the invention.

BACKGROUND

Antenna arrays, including transmitarrays and reflectarrays, are used in many fields, including satellite communications systems, military communications systems, and civilian communication systems. Existing arrays are flat and, in order to get significantly different electromagnetic characteristics, a different array or antenna must be used.

BRIEF SUMMARY

Embodiments of the subject invention provide novel and advantageous antenna devices, including tightly coupled arrays, transmitarrays, and reflectarrays, and methods of using and fabricating the same. An antenna device can include a plurality of substrates (e.g., planar substrates) each having an antenna element (e.g., a conductive patch). The substrates can be provided in connected series and/or can be provided in an array. The substrates can be part of an origami array such that the entire array is foldable (e.g., on a Miura-Ori structure). The substrates can optionally be attached to a framework that can actuate the substrates to different configurations. By bending, folding, or otherwise repositioning the substrates/array, the electromagnetic characteristics of the antenna device can be easily reconfigured for the desired task without having to replace the antenna device or any section(s) thereof.

In an embodiment, an antenna device can comprise: a first antenna section; a second antenna section physically separate from the first antenna section; and a first bendable hinge connecting the first antenna section to the second antenna section. The first antenna section can comprise a first substrate, a first patch antenna element disposed on the first substrate, and a first conductive trace disposed on the first substrate and in direct physical contact with the first patch antenna element; and the second antenna section can comprise a second substrate, a second patch antenna element disposed on the second substrate and a second conductive trace disposed on the second substrate and in direct physical contact with the second patch antenna element. The first conductive trace can be electrically connected to the second conductive trace such that the first patch antenna element is electrically connected to the second patch antenna element via the first conductive trace and the second conductive trace; and the antenna device can be configured to be foldable such that an angle between the first substrate and the second substrate is alterable by bending the first bendable hinge.

In another embodiment, an antenna device can comprise a plurality of substrates arranged in an array and connected to each other such that they are foldable with respect to one another, and each substrate of the plurality of substrates can comprise a coupled dipole including two antenna elements. The plurality of substrates can be configured to be foldable into a predetermined folded shape by having fold lines among the plurality of substrates, and each substrate of the plurality of substrates can have a thickness of at least 0.5 millimeters (mm).

DETAILED DESCRIPTION

Figure 1A:
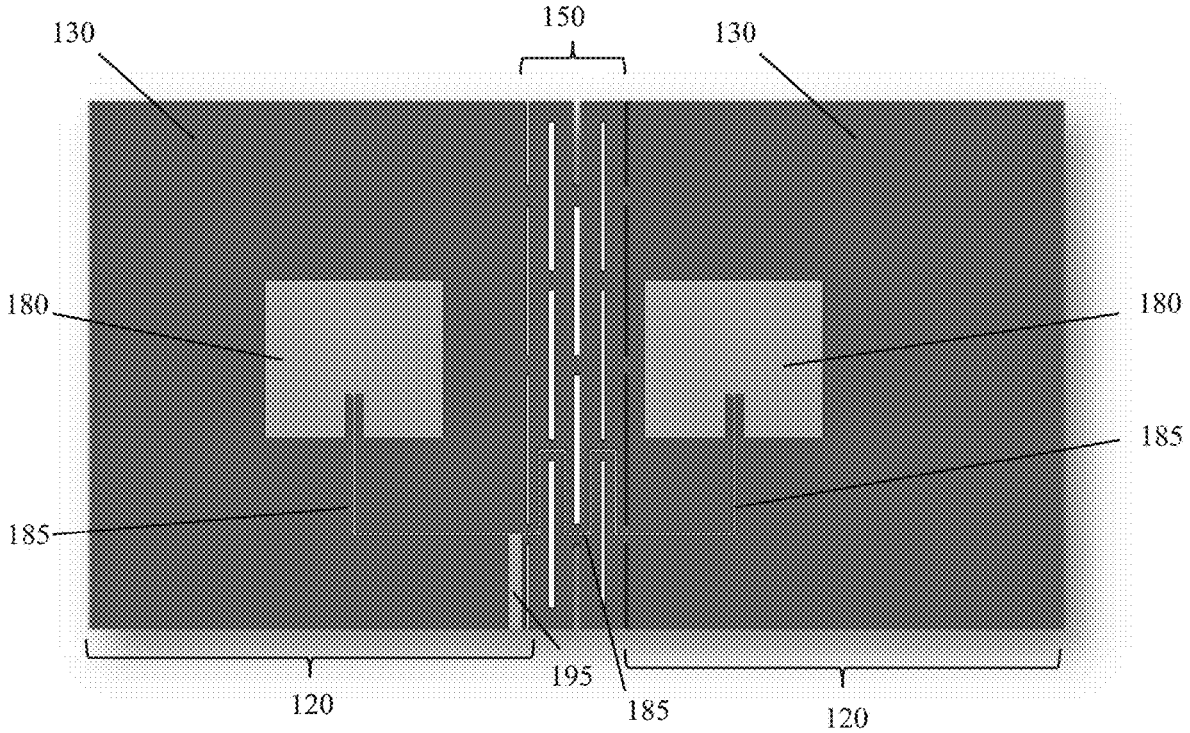
FIG. 1A is a top view showing an antenna device according to an embodiment of the subject invention.

Embodiments of the subject invention provide novel and advantageous antenna devices, including tightly coupled arrays, transmitarrays, and reflectarrays, and methods of using and fabricating the same. An antenna device can include a plurality of substrates (e.g., planar substrates) each having an antenna element (e.g., a conductive patch, printed dipoles, loops, or any other suitable antenna element). The substrates can be provided in connected series and/or can be provided in an array. The substrates can be part of an origami array such that the entire array is foldable (e.g., on a Miura-Ori structure). The substrates can optionally be attached to a framework that can actuate (e.g., via at least one motor of the framework) the substrates to different configurations. By bending, folding, or otherwise repositioning the substrates/array, the electromagnetic (EM) characteristics of the antenna device can be easily reconfigured for the desired task without having to replace the antenna device or any section(s) thereof. In some cases, more than two antenna elements can be used; for example, more than two antenna elements can be placed around one hinge or more than one hinge that can connect multiple elements. Also, in some cases the hinges can be placed in two directions (e.g., x- and y-directions) so that they form a planar array of elements.

Antenna devices (e.g., arrays such as tightly coupled arrays, transmitarrays, and reflectarrays) of embodiments of the subject invention are deployable and can change their EM behavior or characteristics by changing their shape (e.g., by folding at specific fold angles). Such antenna devices have much more control over the steering of their beam(s) than conventional flat arrays. Arrays of embodiments of the subject invention can also achieve high isolation between their elements (e.g., between different antenna elements), if it is desired, by using their folding properties. A hinge can be provided between adjacent antenna elements, and any suitable type of hinge can be used. The arrays can thus fold and unfold as desired, for example using one or more appropriate actuation systems.

Antenna devices (e.g., arrays such as tightly coupled arrays, transmitarrays, and reflectarrays) of embodiments of the subject invention can be thick (e.g., with a thickness of at least 0.5 millimeters (mm) or at least 1, 2, 3, 4, 5, 6, 7, 8, 9, or 10 mm). Such antenna devices can reconfigure their EM characteristics and can also be efficiently packed. The ability of these structures to deform their shape gives an additional degree of freedom for multi-functionality so that the user can direct the beam in a direction while not relying only on the electronic configuration that is conventionally used. Embodiments provide deployable arrays that can achieve enhanced beam steering compared to an equivalent flat array. Such reflectarrays can steer the beam using real-time shape deformation, which is not possible with related art devices. Use of arrays of embodiments of the subject invention can provide enhanced and advantageous capabilities in many fields, including but not necessarily limited to multi-functional communications, satellite communication systems, and deployable and collapsible arrays.

Figure 1B:
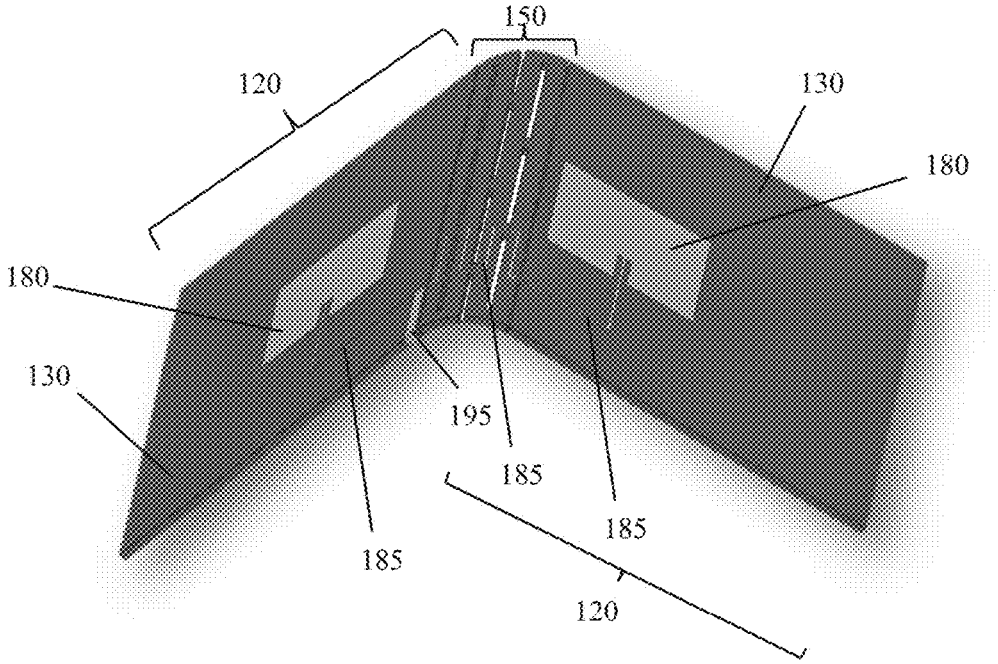
FIG. 1B is a schematic view showing the antenna device of FIG. 1A in a folded state.
Figure 1C:
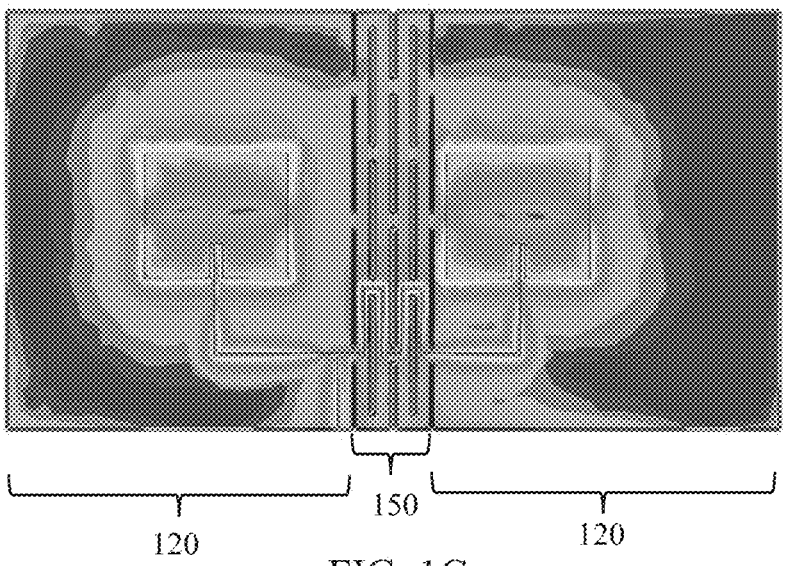
FIG. 1C is a top view showing the electric field (in Volts per meter (V/m) for the antenna device of FIG. 1A in an unfolded state.
Figure 1D:
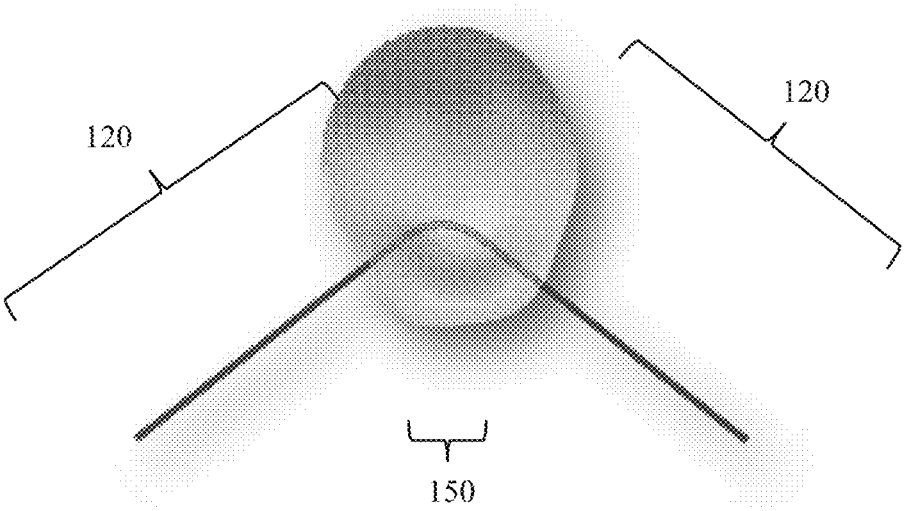
FIG. 1D is a side (edge-on) view showing the radiation pattern for the antenna device of FIG. 1A in a folded state.

FIG. 1A is a top view showing an antenna device according to an embodiment of the subject invention; FIG. 1B is a schematic view showing the antenna device of FIG. 1A in a folded state; FIG. 1C is a top view showing the electric field (in Volts per meter (V/m) for the antenna device of FIG. 1A in an unfolded state; and FIG. 1D is a side (edge-on) view showing the electric field (in V/m) for the antenna device of FIG. 1A in a folded state. Referring to FIGS. 1A and 1B, the antenna device can include a plurality of antenna sections 120 (e.g., planar antenna sections) connected to each other. Each antenna section 120 can include a patch 180 (i.e., antenna element) disposed on a substrate 130 (e.g., a planar substrate). Adjacent antenna sections 120 can be connected to each other via a hinge 150, which can be made of the same material as the substrate(s) 130 or a different material. The hinge 150 is bendable such that a folding angle (see, e.g., FIGS. 6B-6D) can be changed by bending the hinge 150. Patches 180 on adjacent antenna sections 120 can be electrically connected to each other using a conductive trace 185, which can also be disposed on the hinge 150. The conductive trace 185 can be in direct physical contact with the substrate 130 and/or the hinge 150. One or more of the antenna sections 120 can include a contact 195 in electrical contact with the patch 180 on that antenna section 120 (and the patch(es) on other antenna sections), for example via the conductive trace 185 (e.g., the conductive trace 185 can be in direct physical contact with the contact 195. The contact 195 can be configured to provide electrical connection to an external device (e.g., a power source). Referring to FIGS. 1C and 1D, the EM characteristics of the antenna device change when it is folded.

FIGS. 1A-1D show two antenna sections 120 for demonstrative purposes only, but embodiments of the subject invention are not limited thereto. Any desired number of antenna sections 120 can be present, connected in a series and/or an array. In some embodiments, a hinge 150 can be present between each antenna section 120 and each adjacent antenna section 120. Each patch 180 can be electrically connected to each other patch 180 or alternatively, the patch 180 of an antenna section 120 may only be electrically connected to one adjacent antenna section 120.

The material for each substrate 130 can be any suitable material known in the art. For example, the substrates can be paper, cardboard, plastic, or a relatively rigid material such as FR4 (a composite material comprising woven fiberglass cloth with an epoxy resin binder that is flame resistant). In an embodiment, the substrates 130 can all be the same material, and in alternative embodiment, multiple different materials can be used for respective substrates 130.

The material for each patch 180 can be any suitable material known in the art. For example, each patch 180 can be copper, aluminum, gold, silver, or platinum. In an embodiment, the patches 180 can all be the same material, and in alternative embodiment, multiple different materials can be used for respective patches 180.

The material for the conductive trace(s) 185 can be any suitable material known in the art. For example, each conductive trace 185 can be copper, aluminum, gold, silver, or platinum. In an embodiment, the conductive traces 185 can all be the same material, and in alternative embodiment, multiple different materials can be used for respective conductive traces 185 (if multiple conductive traces are present).

The material for the contact(s) 195 can be any suitable material known in the art. For example, each contact 195 can be copper, aluminum, gold, silver, or platinum. In an embodiment, the contacts 195 can all be the same material, and in alternative embodiment, multiple different materials can be used for respective contacts 195 (if multiple contacts are present). Also, the same material can be used for the patches 180, conductive trace(s) 185, and contact(s) 195, or multiple different materials can be used for these elements.

The antenna device can be configured such that, when the plurality of substrates are folded in the predetermined folded shape, an angle between each substrate of the plurality of substrates and each adjacent substrate of the plurality of substrates is 45° (or any other angle between 0 and 360°). The angle between the substrates can vary from 0° or almost 0° to 360° or almost 360° degrees (the substrate has thickness and can lead to the angle being not quite 0 or 360 degrees). Depending on the angle, different electromagnetic performance can be achieved, and for the case that the angle is ~0° or almost ~360° the array is totally folded (this case can be used to pack the array).

Figure 2A:
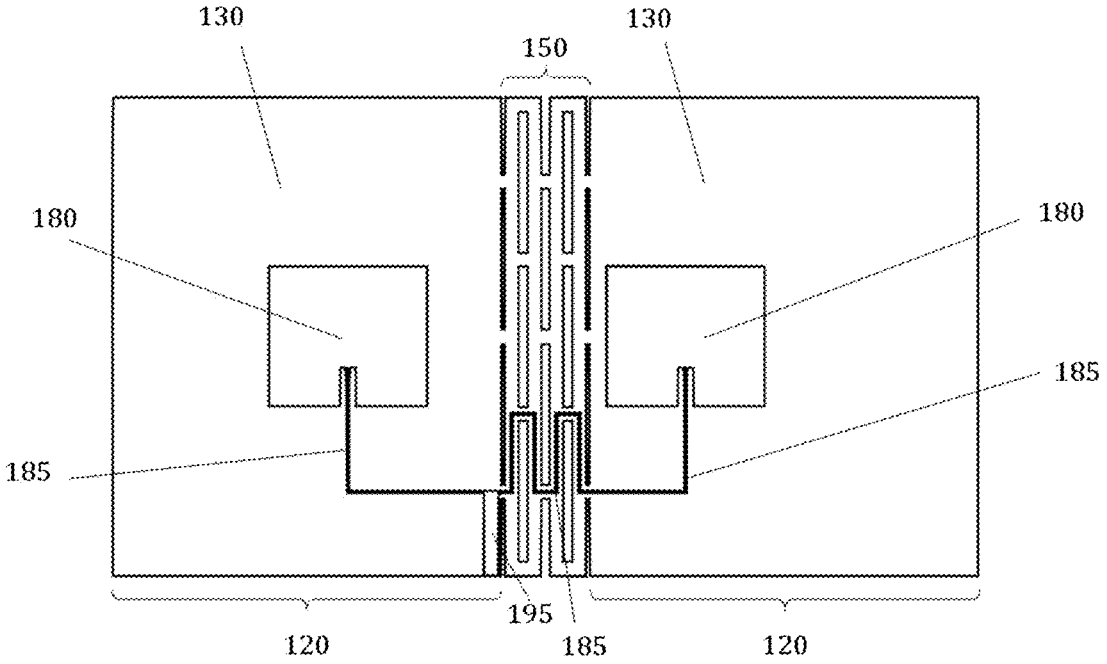
FIG. 2A is a top view showing an image of an antenna device according to an embodiment of the subject invention.
Figure 2B:
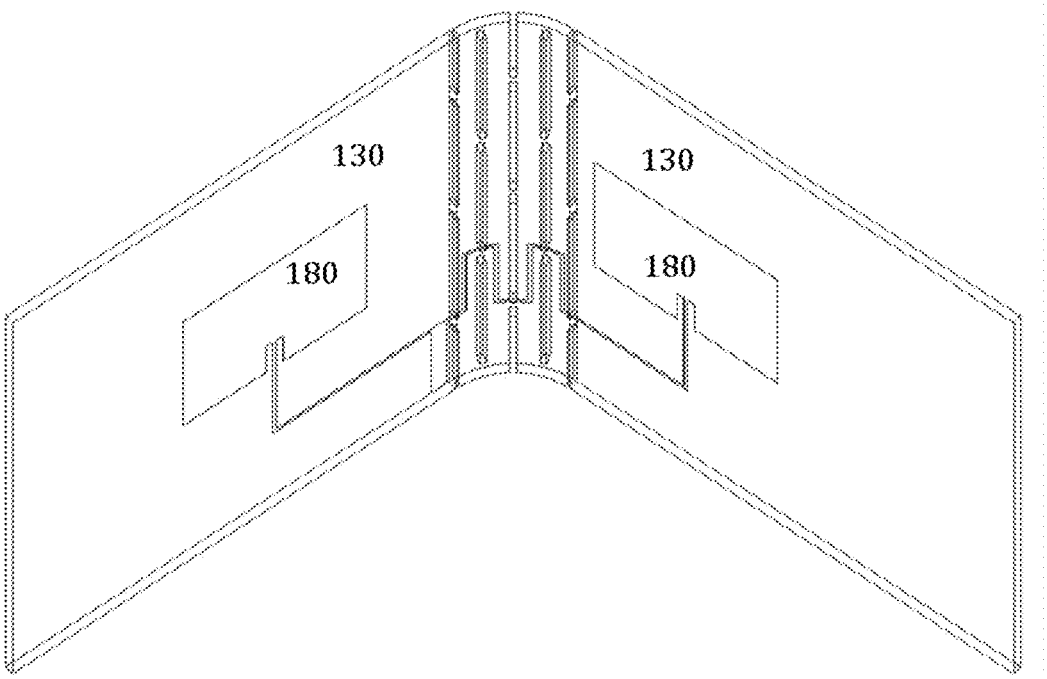
FIG. 2B is a top view of an image of the antenna device of FIG. 2A in a folded state.
Figure 2C:
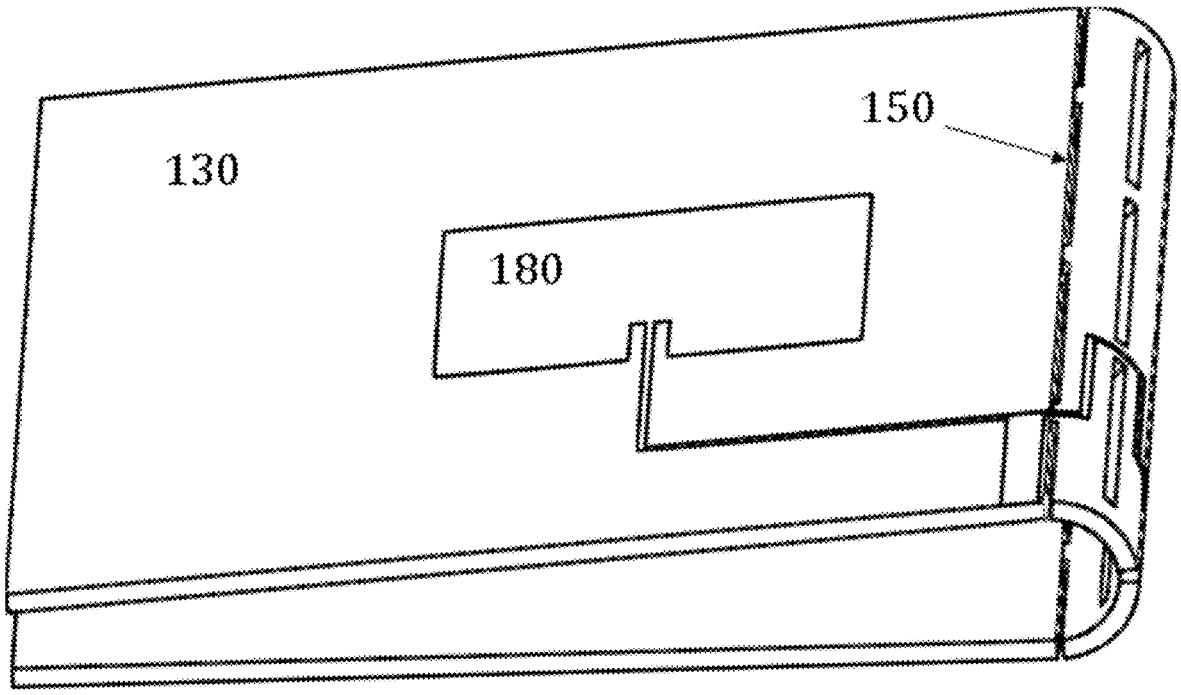
FIG. 2C is a top view of an image of the antenna device of FIG. 2A in a completely folded state.

FIGS. 2A-2C show an antenna device with two antenna sections 120 in an unfolded state (FIG. 2A), a first folded state (FIG. 2B), and a second folded state (FIG. 2C). Referring to FIGS. 2A-2C, the hinge 150 can allow folding to any degree, including up to a 180° fold angle, as seen in FIG. 2C.

Figure 3A:
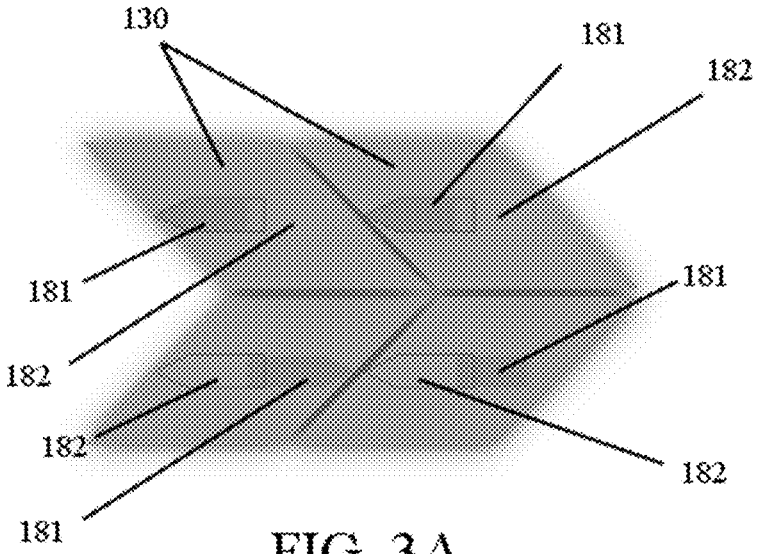
FIG. 3A is a top view showing a unit cell of an antenna device (e.g., tightly coupled dipoles) according to an embodiment of the subject invention.
Figure 3B:
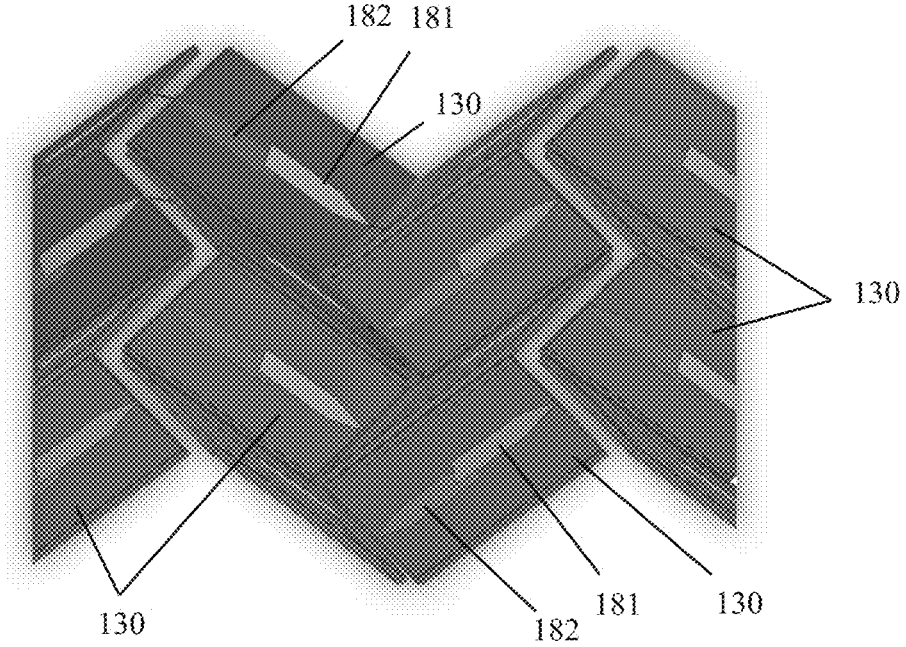
FIG. 3B is a schematic view showing a periodic origami design (e.g., a Miura-Ori origami design) loaded with tightly coupled dipoles according to an embodiment of the subject invention (in a folded state).

FIG. 3A is a top view showing an antenna device according to an embodiment of the subject invention. Referring to FIG. 3A, an antenna device can include substrates 130 that are connected to each other such that they are foldable with respect to one another (see also, e.g., FIG. 3B). Each substrate can include a coupled dipole including two antenna elements 181,182, which can also be referred to as dipoles or dipole elements. This antenna device can be referred to as a tightly coupled dipole array. FIG. 3A shows the array in a flat (unfolded) state. FIG. 3B is a schematic view showing a tightly coupled dipole array antenna device according to an embodiment of the subject invention, in a folded state. In particular, the tightly coupled dipoles are on a Miura-Ori structure, which is a known origami configuration.

Figure 4A:
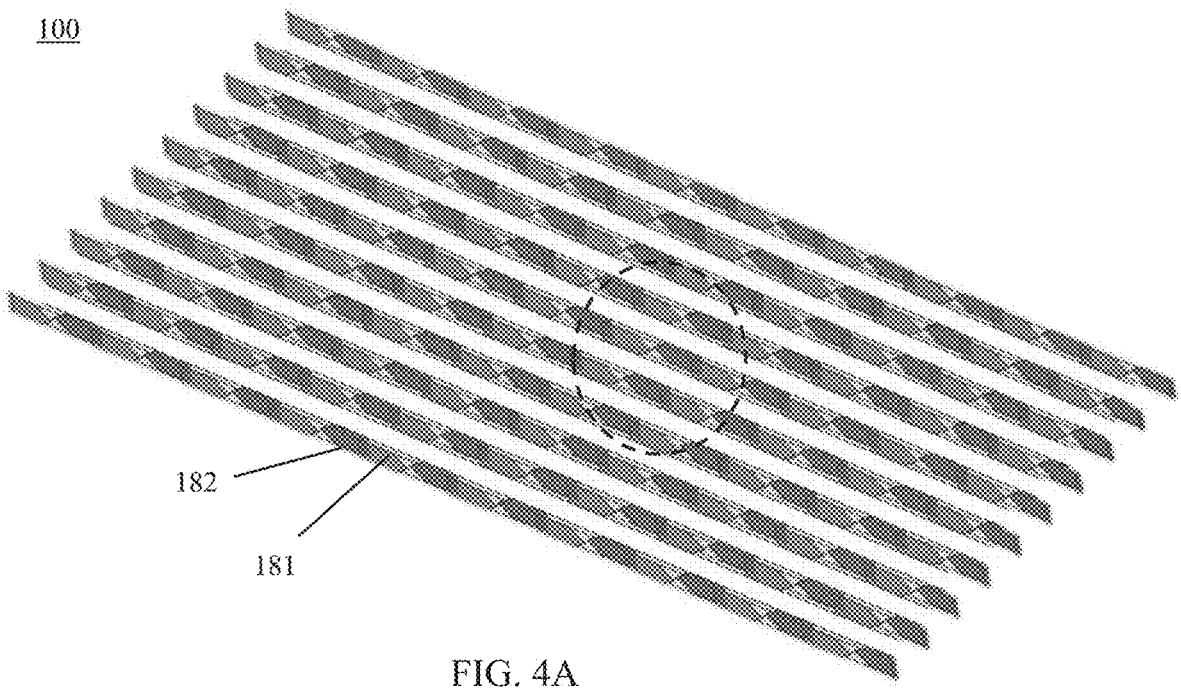
FIG. 4A is a schematic view showing an antenna device with a tightly coupled array according to an embodiment of the subject invention. The dotted circle is provided to show what portion is enlarged in FIG. 4B; the dotted circle is not part of the device.
Figure 4B:
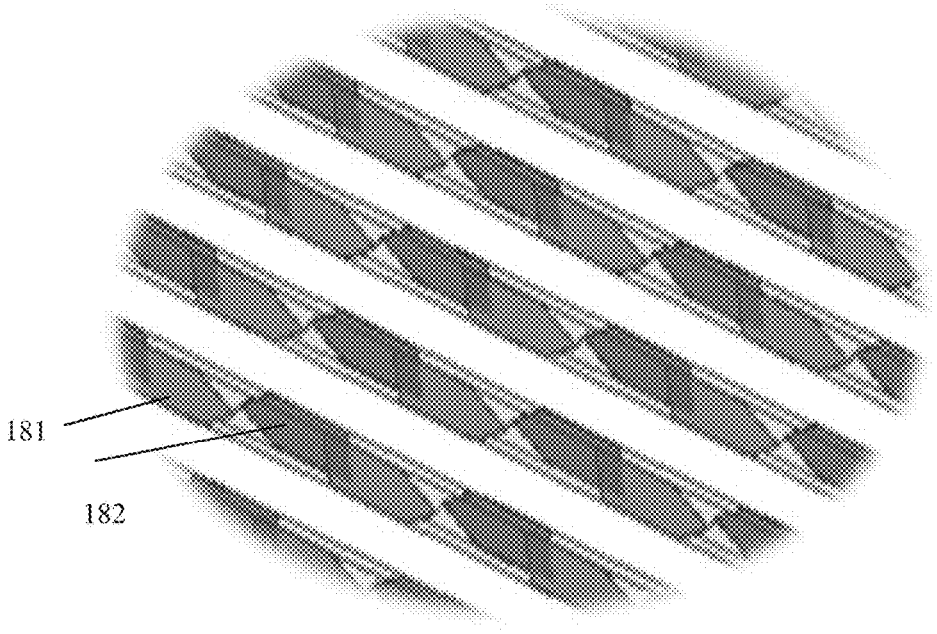
FIG. 4B is a schematic view showing an enlarged version of the portion highlighted with the dotted circle in FIG. 4A.

FIG. 4A is a schematic view showing an antenna device 100 with a tightly coupled array according to an embodiment of the subject invention, and FIG. 4B is a schematic view showing an enlarged version of the portion highlighted with the dotted circle in FIG. 4A. FIGS. 4A and 4B show another example of tightly coupled dipoles 181,182 in an array.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

An antenna device comprising two antenna sections (similar to that shown in FIG. 1A) was fabricated, and images of the antenna device are shown in FIGS. 2A-2C. The reflection coefficient was measured across a range of frequencies in an unfolded state and then at various folded states. In addition, the electric field, E-plane, and H-plane were measured for the device in an unfolded state at 2.4 GHz.

Figure 5:
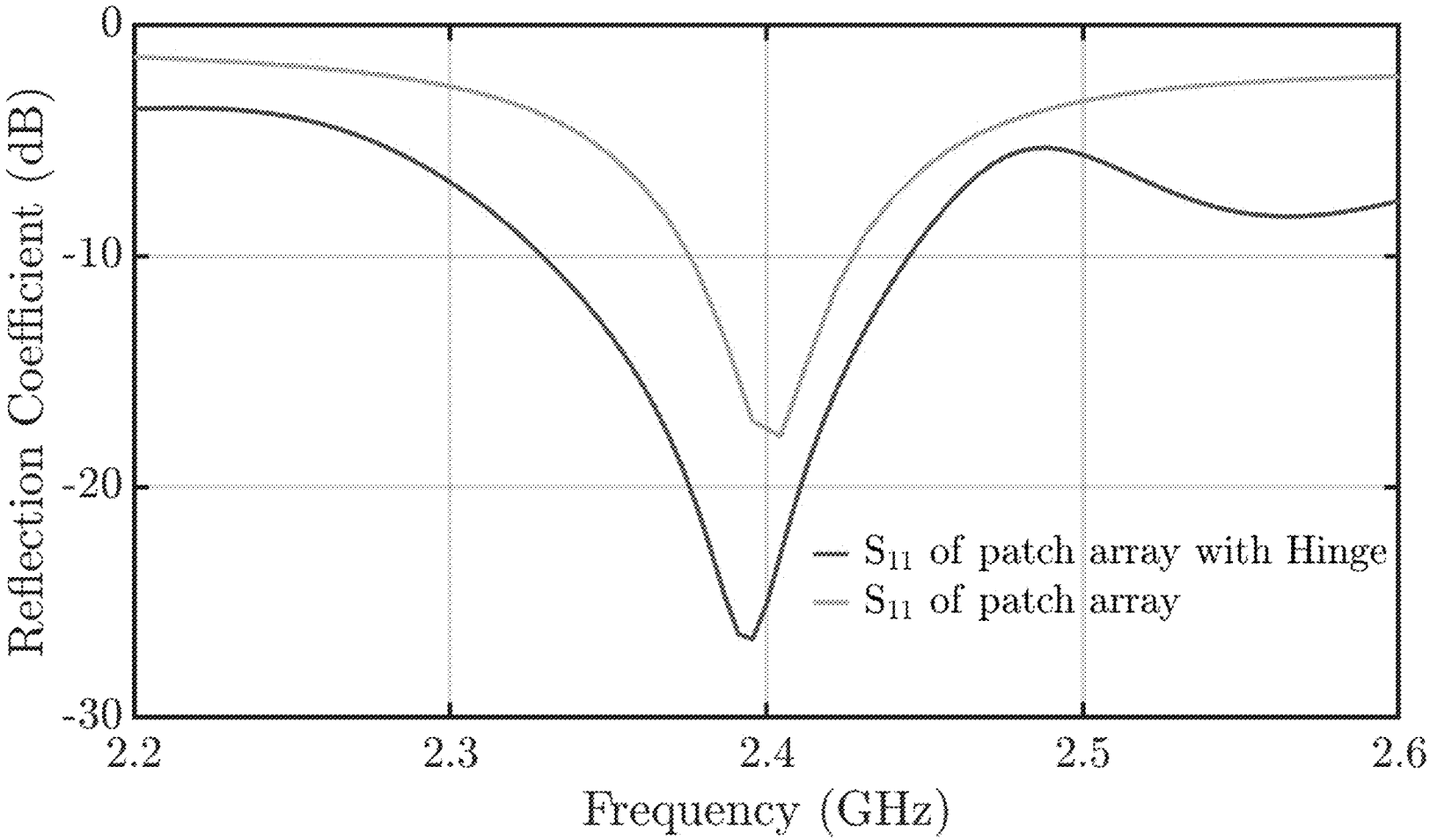
FIG. 5 is a plot of reflection coefficient (in decibels (dB)) versus frequency (in GHz) for a patch array similar to that shown in FIG. 1 (but without a hinge) and for the antenna device shown in FIG. 1 (with the hinge), in an unfolded state. The upper (orange) line is for the patch array without the hinge; and the lower (blue) line is for the antenna device of FIG. 1 (with the hinge).

FIG. 5 is a plot of the reflection coefficient (in decibels (dB)) versus frequency (in GHz) for the patch array in an unfolded state compared to a similar device that does not have a hinge) and for the antenna device shown in FIG. 1 (with the hinge), in an unfolded state. The upper line is for the patch array without the hinge, and the lower line is for the antenna device with the hinge.

Figure 6A:
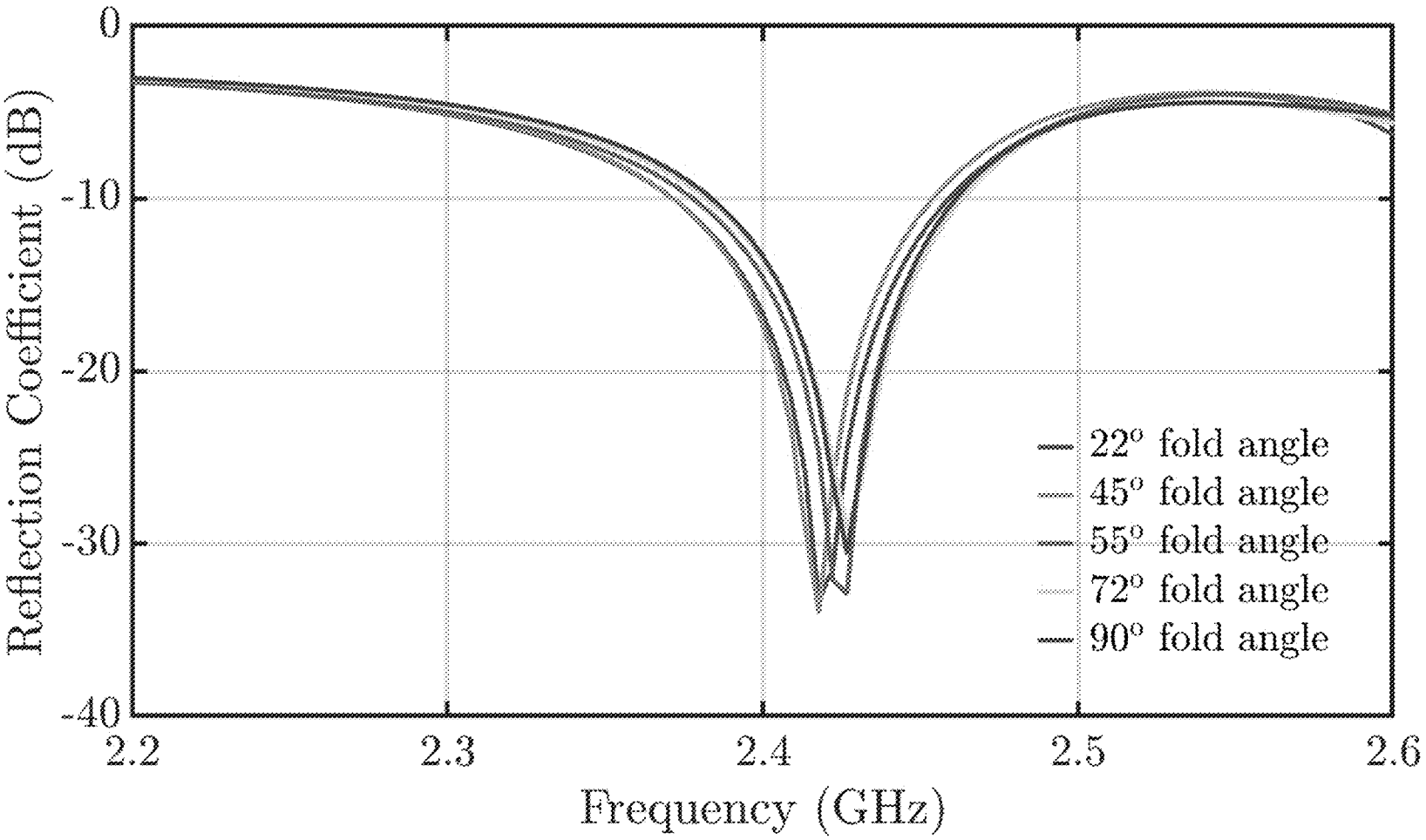
FIG. 6A is a plot of reflection coefficient (in dB) versus frequency (in GHz) for the antenna device shown in FIG. 1 (with the hinge) at different fold angles, where the fold angle is measured as the angle between the substrate in the folded state and the substrate location as it was in the unfolded state (see also FIGS. 6B-6D for how the fold angle is measured). The (dark purple) line with the highest reflection coefficient at 2.4 GHz is for a fold angle of 90°; the (yellow) line with the second-highest reflection coefficient at 2.4 GHz is for a fold angle of 72°; the (lighter purple) line with the third-highest reflection coefficient at 2.4 GHz is for a fold angle of 55°; the (blue) line with the fourth-highest reflection coefficient at 2.4 GHz is for a fold angle of 22°; and the (green) line with the lowest reflection coefficient at 2.4 GHz is for a fold angle of 45°.
Figure 6B:
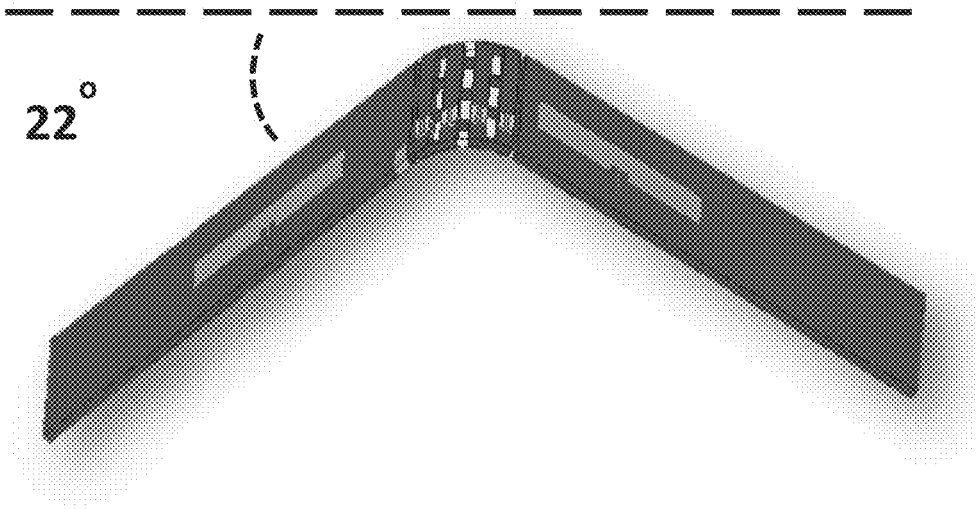
FIG. 6B shows a schematic view of the antenna device of FIG. 1 folded with a fold angle of 22°.
Figure 6C:
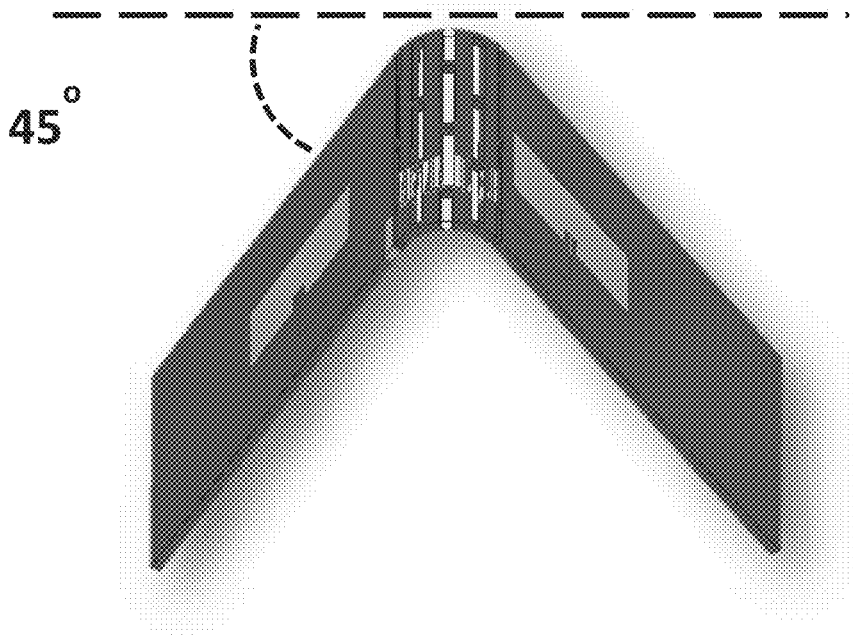
FIG. 6C shows a schematic view of the antenna device of FIG. 1 folded with a fold angle of 45°.
Figure 6D:
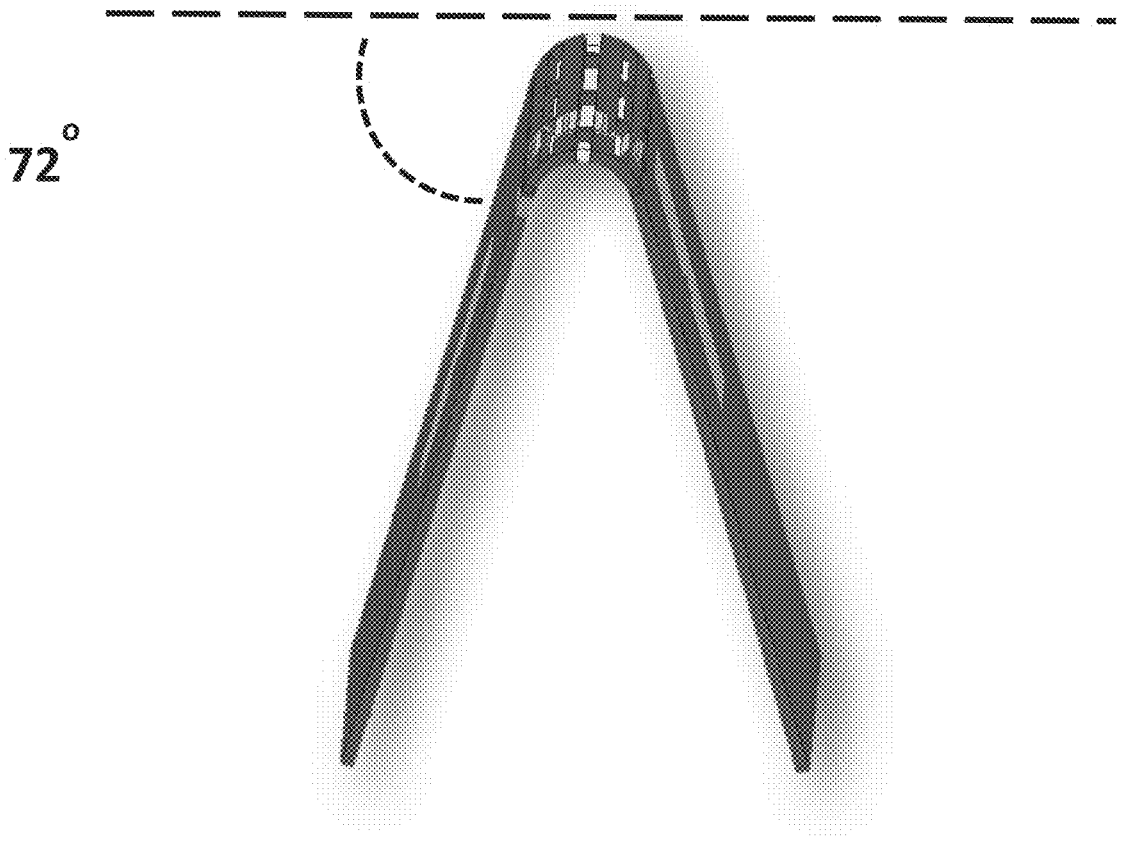
FIG. 6D shows a schematic view of the antenna device of FIG. 1 folded with a fold angle of 72°.

FIG. 6A is a plot of the reflection coefficient (in dB) versus frequency (in GHz) for the antenna device at different fold angles, where the fold angle is measured as the angle between the substrate in the folded state and the substrate location as it was in the unfolded state (see also FIGS. 6B-6D for how the fold angle is measured). The line with the highest reflection coefficient at 2.4 GHz is for a fold angle of 90°; the line with the second-highest reflection coefficient at 2.4 GHz is for a fold angle of 72°; the line with the third-highest reflection coefficient at 2.4 GHz is for a fold angle of 55°; the line with the fourth-highest reflection coefficient at 2.4 GHz is for a fold angle of 22°; and the line with the lowest reflection coefficient at 2.4 GHz is for a fold angle of 45°.

Figure 7A:
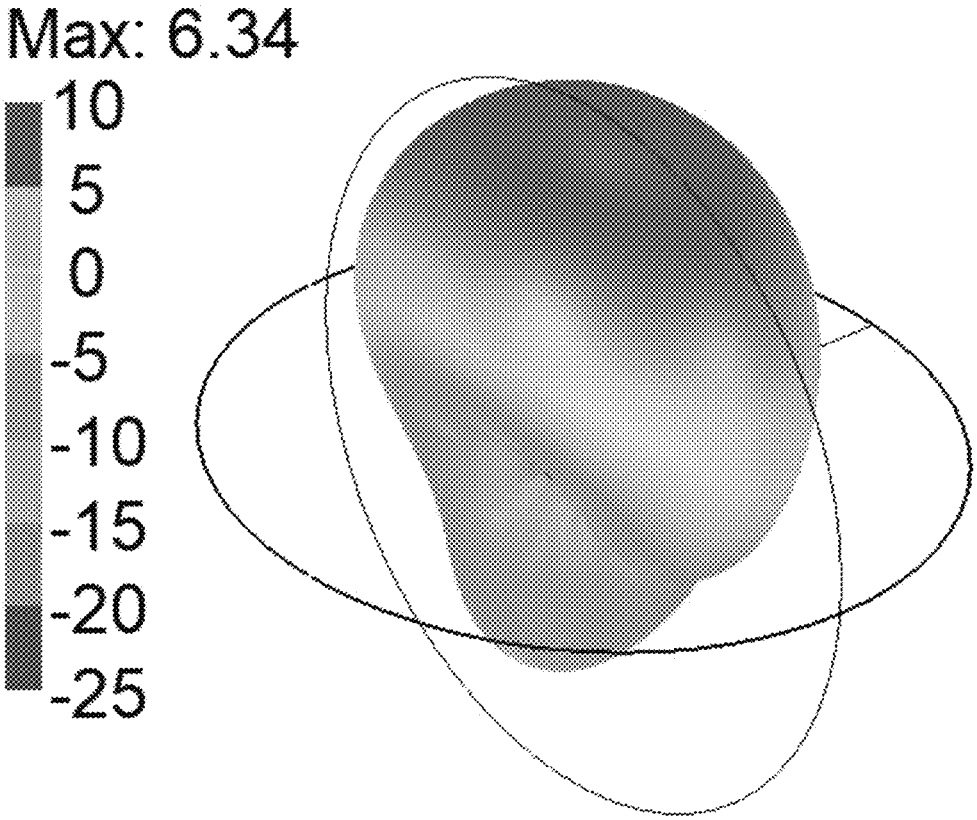
FIG. 7A shows the electric field (in V/m) for the antenna device of FIG. 1A in an unfolded state at 2.4 GHz.
Figure 7B:
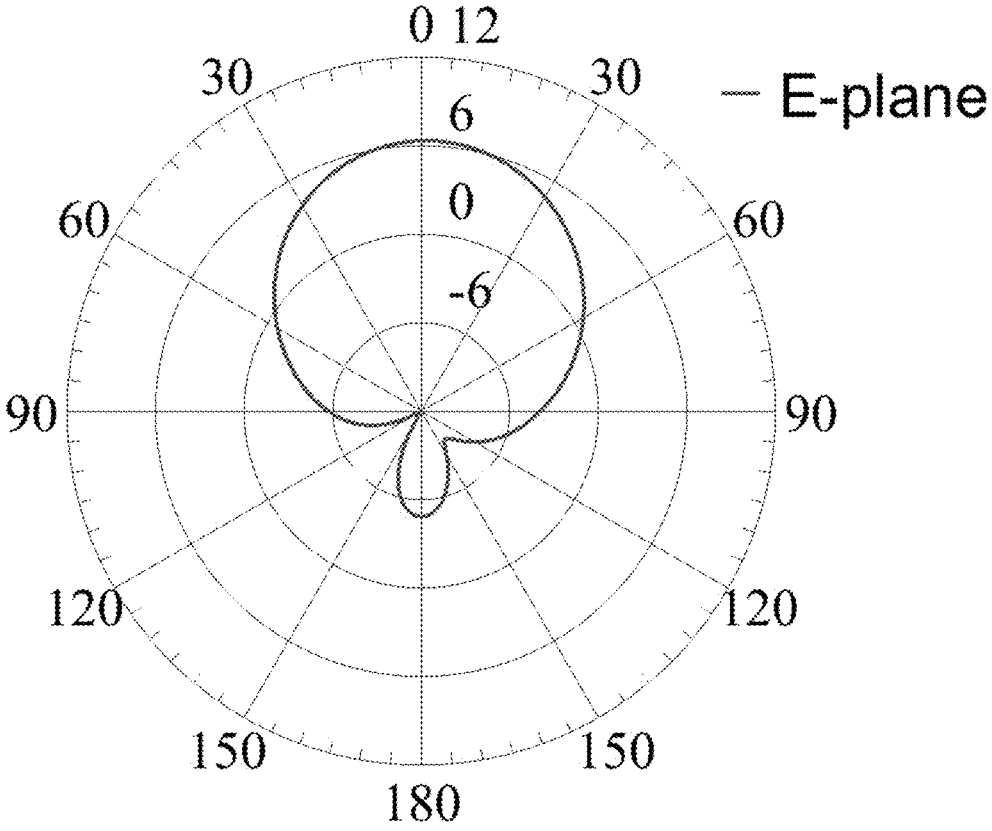
FIG. 7B shows the E-plane (electrical characteristics) for the antenna device of FIG. 1A in an unfolded state at 2.4 GHz.
Figure 7C:
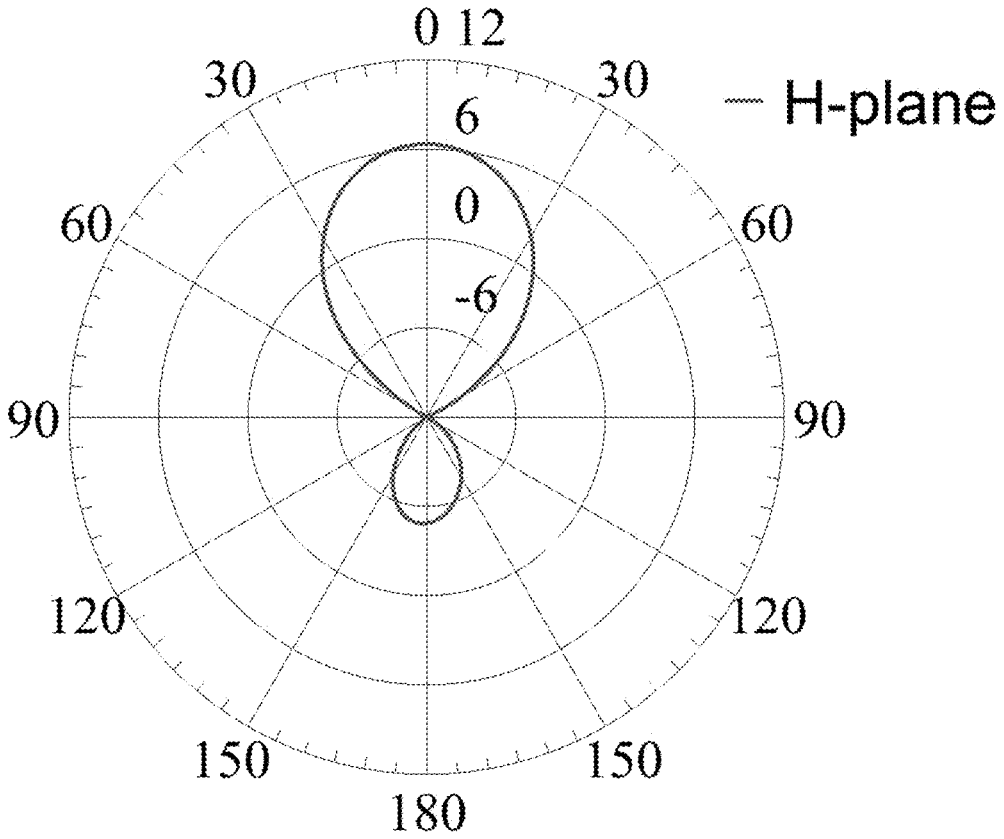
FIG. 7C shows the H-plane (magnetic characteristics) for the antenna device of FIG. 1A in an unfolded state at 2.4 GHz.

FIG. 7A shows the electric field (in V/m) for the antenna device in an unfolded state at 2.4 GHz; FIG. 7B shows the E-plane (electrical characteristics) for the antenna device of in an unfolded state at 2.4 GHz; and FIG. 7C shows the H-plane (magnetic characteristics) for the antenna device in an unfolded state at 2.4 GHz.

It can be seen that the EM characteristics can be changed, first by simply adding the hinge (see FIG. 5) and then by folding the antenna device to different fold angles. Use of such antenna devices can provide enhanced and advantageous capabilities in many fields as discussed herein.

Example 2

An antenna device comprising a tightly coupled dipole array (similar to that shown in FIG. 3B) was simulated. The active voltage standing wave ratio (VSWR) was evaluated at different frequencies at a fold angle ($\omega$) of 45° for different TE polarized incident waves of scan angles ($\theta$).

Figure 3C:
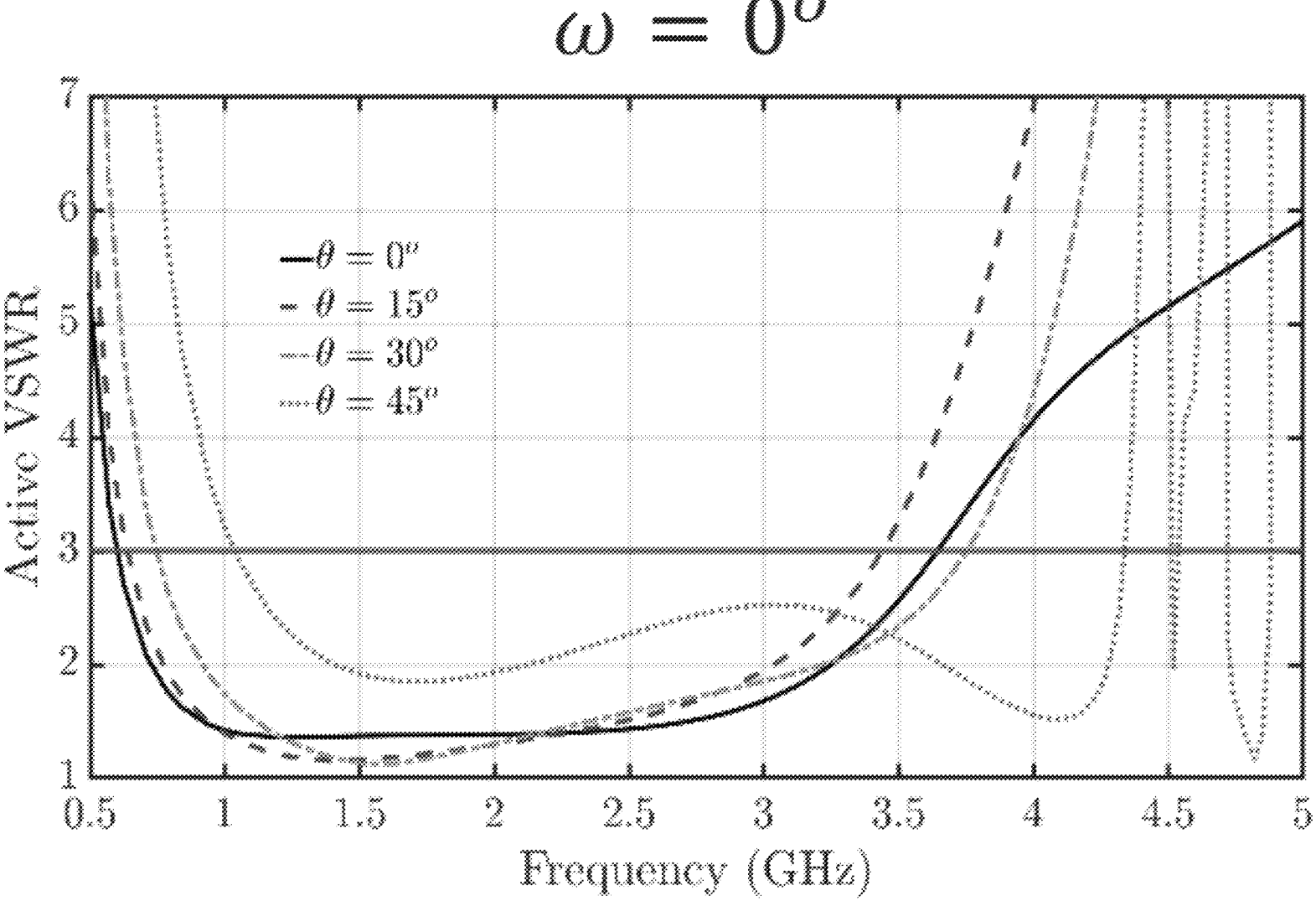
FIG. 3C is a plot of active voltage standing wave ratio (VSWR) versus frequency (in gigahertz (GHz)) for different scan angles (θ) for the antenna device of FIG. 3B, with a fold angle (ω) of 0° when the antenna device is illuminated by a TE polarized plane wave. The (pink) line that has the highest active VSWR at 0.75 GHz is for θ=45°; the (green) line that has the second-highest active VSWR at 0.75 GHz is for θ=30°; the (blue) line that has the third-highest active VSWR at 0.75 GHz is for θ=15°; and the (black) line that has the lowest active VSWR at 0.75 GHz is for θ=0°.

FIG. 3C is a plot of the VSWR versus frequency (in GHz) for the different scan angles ($\theta$) for the antenna device, with a fold angle ($\omega$) of 0°. The line that has the highest active VSWR at 0.75 GHz is for $\theta$=45°; the line that has the second-highest active VSWR at 0.75 GHz is for $\theta$=30°; the line that has the third-highest active VSWR at 0.75 GHz is for 0=15°; and the line that has the lowest active VSWR at 0.75 GHz is for $\theta$=0°.

It can be seen that the EM characteristics can be changed by using different E-field scan angles.

Example 3

An antenna device comprising a tightly coupled dipole array (similar to that shown in FIG. 3B) was simulated, this time with a square loop printed on the substrates. The active VSWR was evaluated at different frequencies at a fold angle (ω) of 45° for different TM polarized incident waves of scan angles (θ).

Figure 3D:
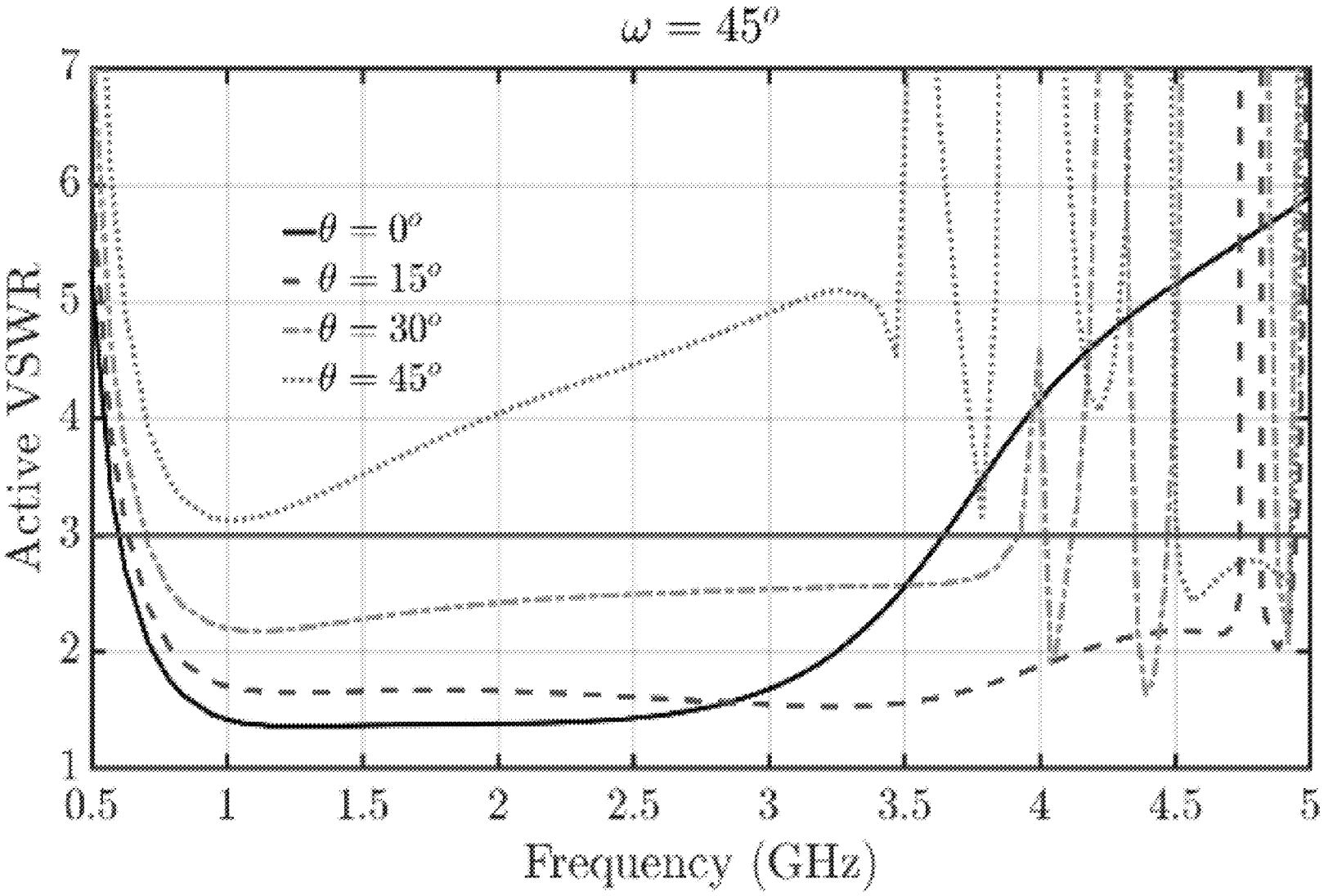
FIG. 3D is a plot of active VSWR versus frequency (in GHz) for different scan angles (θ) for an antenna device similar to that of FIG. 3B with a fold angle (ω) of 45° when the antenna device is illuminated by a TE polarized plane wave. The (pink) line that has the highest active VSWR at 0.75 GHz is for θ=45°; the (green) line that has the second-highest active VSWR at 0.75 GHz is for θ=30°; the (blue) line that has the third-highest active VSWR at 0.75 GHz is for θ=15°; and the (black) line that has the lowest active VSWR at 0.75 GHz is for θ=0°.

FIG. 3D is a plot of the VSWR versus frequency (in GHz) for the different scan angles (θ) for the antenna device, with a fold angle (ω) of 45°. The line that has the highest active VSWR at 0.75 GHz is for θ=45°; the line that has the second-highest active VSWR at 0.75 GHz is for θ=30°; the line that has the third-highest active VSWR at 0.75 GHz is for 0=15°; and the line that has the lowest active VSWR at 0.75 GHz is for θ=0°.

It can be seen again that the EM characteristics can be changed by using different E-field scan angles.

Referring to FIGS. 3C and 3D, it has been shown that by folding the array of FIGS. 3A and 3B enhanced electromagnetic performance is achieved. When the array is folded there are specific scan angles where the VSWR is better compared to the unfolded (flat) case. The blue (θ=15°) and green (θ=30°) lines of FIG. 3D cover a wider frequency range (below the red line that signifies 3 dB) compared to those of FIG. 3C. Thus, by developing arrays with foldable characteristics their electromagnetic performance can be significantly improved.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An antenna device, comprising: a first antenna section;

a second antenna section physically separate from the first antenna section; and a first bendable hinge connecting the first antenna section to the second antenna section, the first antenna section having a first substrate, exactly one patch antenna element disposed on the first substrate, and a first conductive trace disposed on the first substrate and in direct physical contact with the one patch antenna element disposed on the first substrate, the second antenna section having a second substrate, exactly one patch antenna element disposed on the second substrate, and a second conductive trace disposed on the second substrate and in direct physical contact with the one patch antenna element disposed on the second substrate, the first conductive trace being electrically connected to the second conductive trace such that the one patch antenna element disposed on the first substrate is electrically connected to the one patch antenna element disposed on the second substrate via the first conductive trace and the second conductive trace, the antenna device being configured to be foldable such that an angle between the first substrate and the second substrate is alterable, over a full range of from 0° to 180°, by bending the first bendable hinge, the first substrate, the second substrate, and the first bendable hinge each having a thickness of at least 0.5 millimeters (mm), and the antenna device being a reflectarray.

2. The antenna device according to claim 1, further comprising a contact disposed on the first substrate and in direct physical contact with the first conductive trace, the contact being configured to electrically connect to an external device.

3. The antenna device according to claim 1, further comprising a connection conductive trace disposed on the first bendable hinge and in direct physical contact with both the first conductive trace and the second conductive trace.

4. The antenna device according to claim 1, further comprising a framework to which the first antenna section and the second antenna section are attached.

5. The antenna device according to claim 4, the framework being an actuating framework comprising at least one motor, such that the framework is configured to move the first antenna section and the second antenna section to bend the first bendable hinge to alter the angle between the first substrate and the second substrate.

6. The antenna device according to claim 1, the first substrate comprising paper, cardboard, plastic, or FR4, and the second substrate comprising paper, cardboard, plastic, or FR4.

7. The antenna device according to claim 1, the antenna device being an array device comprising an array of antenna sections including the first antenna section, the second antenna section, and a plurality of additional antenna sections, each additional antenna section having a respective substrate, exactly one respective patch antenna element disposed on the respective substrate, and a first conductive trace disposed on the respective substrate and in direct physical contact with the respective one patch antenna element, each antenna section of the array of antenna sections being connected to each adjacent antenna section of the array of antenna sections by a respective bendable hinge, and the respective one patch antenna element of each additional antenna section being electrically connected to the respective one patch antenna element of at least one other additional antenna section.

8. The antenna device according to claim 7, further comprising a framework to which each antenna section of the array of antenna sections is attached.

9. The antenna device according to claim 8, the framework being an actuating framework comprising at least one motor, such that the framework is configured to move the antenna sections of the array of antenna sections with respect to each other to bend the first bendable hinge and each respective bendable hinge.

10. The antenna device according to claim 7, the first substrate, the second substrate, each respective substrate of the plurality of additional antenna sections, and each respective bendable hinge each having a thickness of at least 0.5 mm.

11. The antenna device according to claim 7, the first substrate, the second substrate, and each respective substrate of the plurality of additional antenna sections comprising paper, cardboard, plastic, or FR4.

12. The antenna device according to claim 1, the first substrate, the second substrate, and the first bendable hinge each having a thickness of at least 1 mm.

13. An antenna device, comprising:

a first antenna section;

a second antenna section physically separate from the first antenna section; a first bendable hinge connecting the first antenna section to the second antenna section; and a framework to which the first antenna section and the second antenna section are attached, the first antenna section having a first substrate, exactly one patch antenna element disposed on the first substrate, and a first conductive trace disposed on the first substrate and in direct physical contact with the one patch antenna element disposed on the first substrate, the second antenna section having a second substrate, exactly one patch antenna element disposed on the second substrate, and a second conductive trace disposed on the second substrate and in direct physical contact with the one patch antenna element disposed on the second substrate, the first conductive trace being electrically connected to the second conductive trace such that the one patch antenna element disposed on the first substrate is electrically connected to the one patch antenna element disposed on the second substrate via the first conductive trace and the second conductive trace, the antenna device being configured to be foldable such that an angle between the first substrate and the second substrate is alterable over a full range of from 0° to 180°, by bending the first bendable hinge, the framework being an actuating framework comprising at least one motor, such that the framework is configured to move the first antenna section and the second antenna section to bend the first bendable hinge to alter the angle between the first substrate and the second substrate, the antenna device further comprising a contact disposed on the first substrate and in direct physical contact with the first conductive trace, the contact being configured to electrically connect to an external device, the antenna device further comprising a connection conductive trace disposed on the first bendable hinge and in direct physical contact with both the first conductive trace and the second conductive trace, the antenna device being an array device comprising an array of antenna sections including the first antenna section, the second antenna section, and a plurality of additional antenna sections, each additional antenna section having a respective substrate, exactly one respective patch antenna element disposed on the respective substrate, and a first conductive trace disposed on the respective substrate and in direct physical contact with the respective one patch antenna element, each antenna section of the array of antenna sections being connected to each adjacent antenna section of the array of antenna sections by a respective bendable hinge, and the respective one patch antenna element of each additional antenna section being electrically connected to the respective one patch antenna element of at least one other additional antenna section, each additional antenna section being attached to the framework, the framework being configured to move the antenna sections of the array of antenna sections with respect to each other to bend the first bendable hinge and each respective bendable hinge, the first substrate, the second substrate, each respective substrate of the plurality of additional antenna sections, and each respective bendable hinge each having a thickness of at least 0.5 mm, and the antenna device being a reflectarray.

14. The antenna device according to claim 13, the first substrate, the second substrate, each respective substrate of the plurality of additional antenna sections, and each respective bendable hinge each having a thickness of at least 1 mm.

* * * * *